US006109546A

United States Patent [19]

Ormiston

[11] Patent Number: 6,109,546

[45] Date of Patent: Aug. 29, 2000

[54] LAWN SPRINKLER AND BEARING THEREFORE

[76] Inventor: Timothy G. Ormiston, 1717 Sycamore St., Twin Lakes, Wis. 53181

[21] Appl. No.: 09/246,796

[22] Filed: Feb. 9, 1999

[51] Int. Cl.[7] ..... B05B 3/00

[52] U.S. Cl. ..... 239/245; 239/253; 239/261; 239/262; 239/280

[58] Field of Search ..... 239/273, 276, 239/280, 243, 245, 251, 253, 261, 262

[56] References Cited

U.S. PATENT DOCUMENTS

| | | | |
|---|---|---|---|
| 130,798 | 8/1872 | Finley | 239/245 |
| 153,844 | 8/1874 | Pungs | 239/245 |
| 165,668 | 7/1875 | Galvin | 239/245 |
| 1,766,514 | 6/1930 | Henry | 239/251 |
| 2,677,577 | 5/1954 | Miller | 239/262 |
| 3,253,784 | 5/1966 | Long et al. | 239/251 |
| 5,104,044 | 4/1992 | Ratell, Jr. | 239/261 |
| 5,211,337 | 5/1993 | Lukez | 239/251 |

FOREIGN PATENT DOCUMENTS

| | | | |
|---|---|---|---|
| 1171635 | 11/1969 | United Kingdom | 239/251 |

*Primary Examiner*—Lesley D. Morris
*Assistant Examiner*—Christopher S. Kim
*Attorney, Agent, or Firm*—Jansson, Shupe, Bridge & Munger, Ltd.

[57] ABSTRACT

A lawn sprinkler and bearing therefore is provided. The lawn sprinkler has first and second rotatable sprinkler elements supported on a support stand. The bearing allows the sprinkler elements to rotate in opposite directions to evenly distribute fluid over an area to be irrigated.

14 Claims, 4 Drawing Sheets

LAWN SPRINKLER AND BEARING THEREFORE

BACKGROUND AND SUMMARY OF THE INVENTION

This invention relates generally to lawn sprinklers, and in particular, to a bearing for a lawn sprinkler which facilitates the even distribution of fluid by the lawn sprinkler over an enlarged area to be irrigated.

As is known, lawn sprinklers are used to irrigate lawns, gardens and the like. Typically, lawn sprinklers are interconnected to a fluid source through a tube or hose. The fluid flows from the source, through the lawn sprinkler, and exits the lawn sprinkler through a plurality of nozzles or openings therein such that the fluid is distributed over an enlarged area to be irrigated. In order to prevent the collection of fluid at a particular locale, it is highly desirable for the lawn sprinkler to evenly distribute the fluid over the entire area to be irrigated.

Heretofore, prior art lawn sprinklers incorporated a fluid dispersing element having a plurality of nozzles therein. In order to effectuate the even distribution of the fluid over the area to be irrigated, the fluid dispersing elements either rotated or oscillated during application of the fluid in response to the pressure of the fluid flowing therethrough. While such prior art lawn sprinklers are adequate in most respects, it has been found that such lawn sprinklers fail to dispense fluid onto the entire area for which irrigation is sought. Consequently, it is also highly desirable to provide a lawn sprinkler which distributes the fluid over a greater portion of the area to be irrigated.

Therefore, it is a primary object of the present invention to provide a bearing for a lawn sprinkler which facilitates the even distribution of fluid by the lawn sprinkler over an enlarged area.

It is a further object and feature of the present invention to provide a bearing for a lawn sprinkler which is simple and inexpensive to manufacture.

It is a still further object and feature of the present invention to provide a bearing for a lawn sprinkler which allows for the lawn sprinkler to incorporate two (2) counter-rotating fluid distributing elements.

In accordance with the present invention, a bearing for rotatably supporting first and second sprinkler elements on a supporting stand is provided. The bearing includes a hollow, generally cylindrical bushing extending along a longitudinal axis and defining a fluid receiving chamber therein. The bushing includes a first open end operatively connected to the supporting stand such that the fluid receiving chamber communicates with the interior thereof, and a second, opposite closed end. The bushing further includes first and second sets of circumferentially spaced apertures therein. The first set of apertures is received within the interior of the first sprinkler element and the second set of apertures is received within the interior of the second sprinkler element. A tubular bushing sleeve is rotatably received on the bushing. The bushing sleeve has an aperture extending therethrough. The aperture in the bushing sleeve lies in a common plane with the first set of apertures in the bushing such that interior of the first sprinkler element successively communicates with the fluid receiving chamber in the bushing through the aperture in the bushing sleeve and through one of the first set of apertures in the bushing in response to rotation of the bushing sleeve about the bushing.

The bearing further includes a generally tubular support sleeve rotatably supported on the bushing. The support sleeve extends along a longitudinal axis between the first and second set of apertures in the bushing. The support sleeve is partially received in the second sprinkler element in a fixed relationship such that the second sprinkler element and the support sleeve rotate in unison about the bushing.

It is contemplated that the bushing sleeve extends through the first sprinkler element in a fixed relationship such that the aperture in the bushing sleeve is aligned with the interior of the first sprinkler element and such that the bushing sleeve and the first sprinkler element rotate in unison about the bushing. The bushing sleeve includes a second aperture spaced from the first aperture. The second aperture is aligned with the interior of the first sprinkler element and lies in a common plane with the first set of apertures in the bushing. A collar may extend radially from the open end of the bushing and engage the support stand in order to prevent axial movement on the bushing on the support stand.

In accordance with a further aspect of the present invention, a bearing for a lawn sprinkler is provided. The lawn sprinkler has first and second rotatable sprinkler elements supported on a support stand. The bearing includes a hollow, generally cylindrical bushing which extends along a longitudinal axis and defines a fluid receiving chamber therein. The fluid receiving chamber communicates with the interior of the support stand. The bushing includes a first set of circumferentially spaced apertures therein which are received within the interior of the first sprinkler element. A bushing sleeve is interconnected to and extends through the first sprinkler element. The bushing sleeve is rotatably received on the bushing and has an aperture extending therethrough. The aperture in the bearing sleeve lies in a common plane with the first set of apertures in the bushing such that the interior of the first sprinkler element successively communicates with the fluid receiving chamber in the bushing through the aperture in the bushing sleeve and through one of the first set of apertures in the bushing in response to rotation of the bushing sleeve about the bushing.

The bushing may also include a second set of circumferentially spaced apertures therein. The second set of apertures is longitudinally spaced from the first set of apertures in the bushing and is received within the interior of the second sprinkler element. A generally tubular support sleeve is rotatably supported on the bushing. The support sleeve extends along the longitudinal axis between the first and second set of apertures in the bushing. The support sleeve is partially received in the second sprinkler element in a fixed relationship such that the second sprinkler element and the support sleeve rotate in unison about the bushing.

The bushing sleeve may include a second aperture circumferentially spaced from the first aperture in the bushing sleeve and aligned with the interior of the first sprinkler element. The second aperture in the bushing sleeve lies with a common plane with the first set of apertures in the bushing. The interior of the first sprinkler element successively communicates with the fluid receiving chamber in the bushing through the second aperture in the first tubular sleeve and through one of the first set of apertures in the bushing in response to rotation of the first sprinkler element about the longitudinal axis.

In accordance with a still further aspect of the present invention, a lawn sprinkler is provided. The lawn sprinkler includes a hollow support stand extending along longitudinal axis. The support stand is connected to a fluid source for transmitting fluid there through. A generally cylindrical bushing extends along a longitudinal axis and defines a fluid receiving chamber therein. The fluid receiving chamber communicates with the interior of the support stand. The bushing includes a first set of circumferentially spaced apertures therein. A bushing sleeve extends through and is interconnected to a fluid distributing member. The fluid distributing member has a plurality of fluid dispersing openings therein. The bushing sleeve is rotatably received on the bushing and has an aperture therethrough. The aperture in the bushing sleeve lies in a common plane with the first set of apertures in the bushing such that the interior of the fluid distributing member successively communicates with the fluid receiving chamber in the bushing through the aperture in the bushing sleeve and through one of the first set of apertures in the bushing in response to rotation of the bushing sleeve about the bushing.

A generally tubular support sleeve is interconnected to and partially received in a second fluid distributing member. The support sleeve is rotatably supported on the bushing. The bushing further includes a second set of circumferentially spaced apertures therein. The second set of apertures are longitudinally spaced from the first set of apertures in the bushing and are received within the interior of the second fluid distributing member. The bushing sleeve includes a second aperture circumferentially spaced from the first aperture in the bushing sleeve and is aligned with the interior of the first fluid distributing member. The second aperture in the bushing sleeve lies in a common plane with the first set of apertures in the bushing. The interior of the first fluid distributing member successively communicates with the fluid receiving chamber in the bushing through the second aperture in the bushing sleeve and through one of the first set of apertures in the bushing in response to rotation of the bushing sleeve about the bushing. It is contemplated that each of the fluid distributing members rotate in response to the flow of fluid through the fluid dispersing opening therein.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
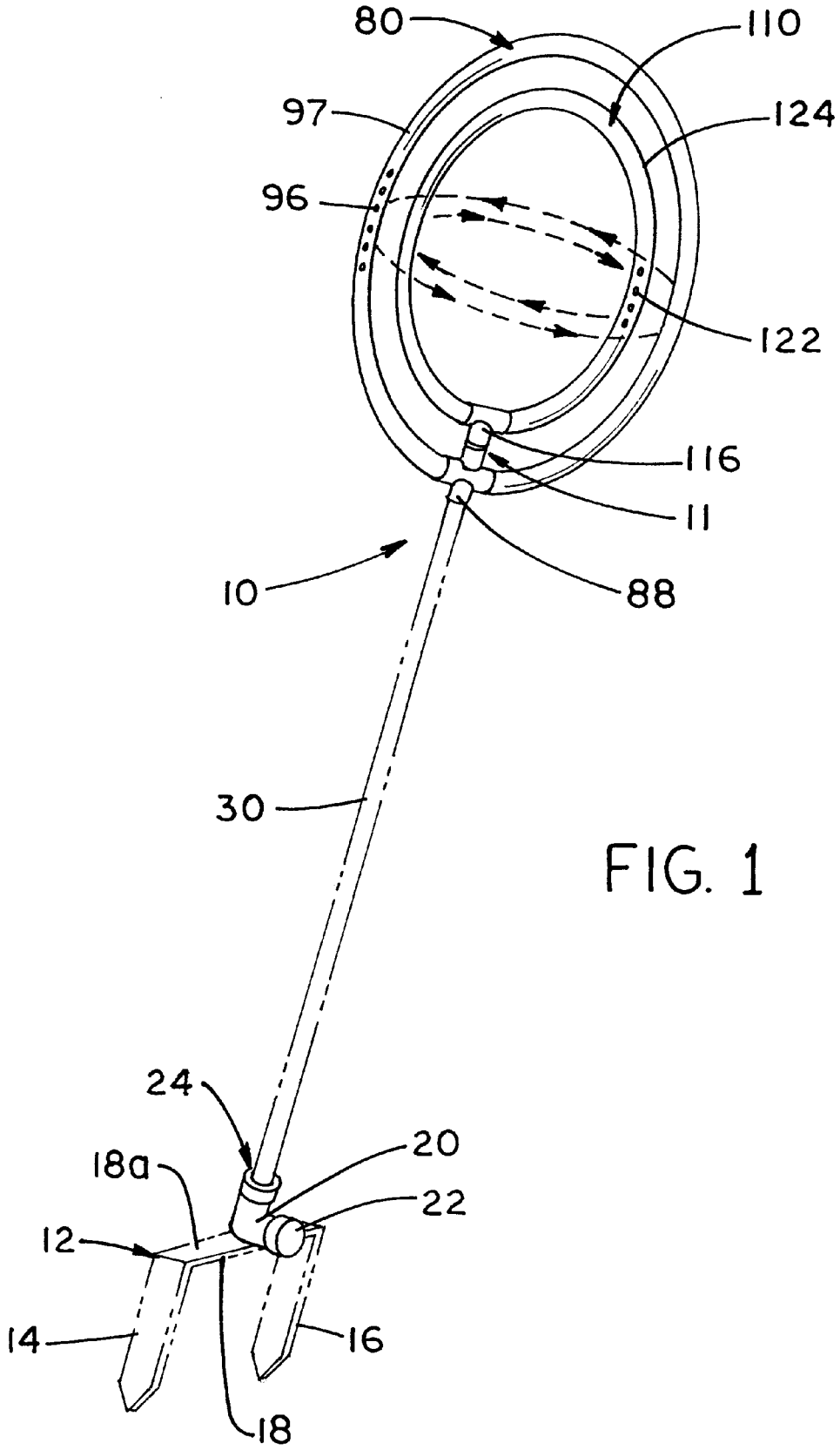
FIG. 1 is an isometric view of a lawn sprinkler incorporating the bearing of the present invention.

Referring to FIG. 1, a lawn sprinkler incorporating the bearing of the present invention is generally designated by the reference numeral 10. The bearing of the present invention is generally designated by the reference numeral 11. Lawn sprinkler 10 includes a generally U-shaped support structure 12 having first and second spikes 14 and 16, respectively, depending from a generally flat horizontal base 18. Horizontal base 18 of support structure 12 includes an upper surface 18*a* having an elbow pipe 20 mounted thereto.

Figure 3:
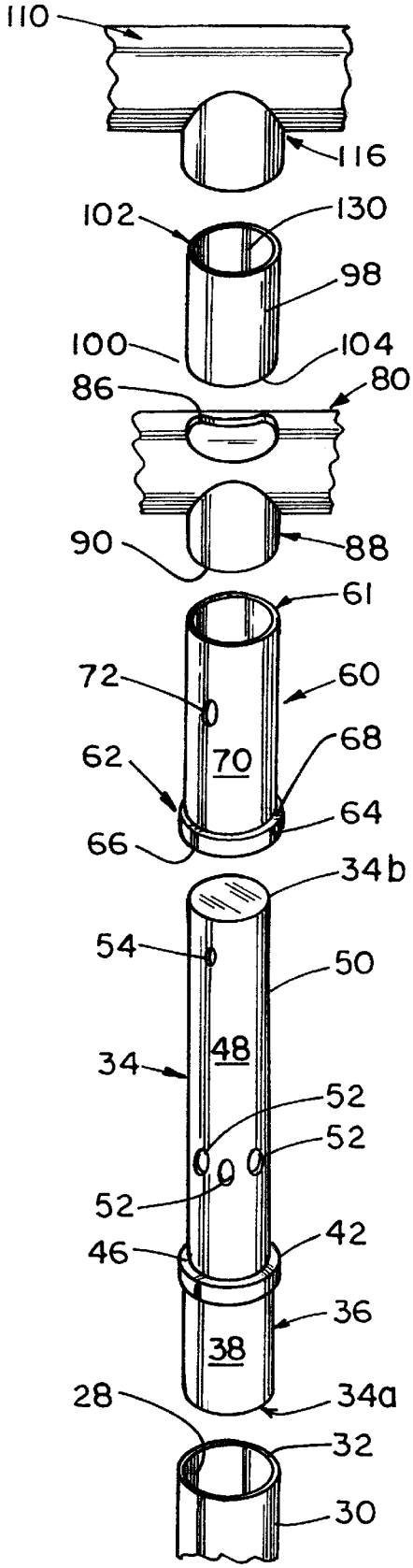
FIG. 3 is an exploded, front elevational view showing a portion of the lawn sprinkler of FIG. 1.
Figure 4:
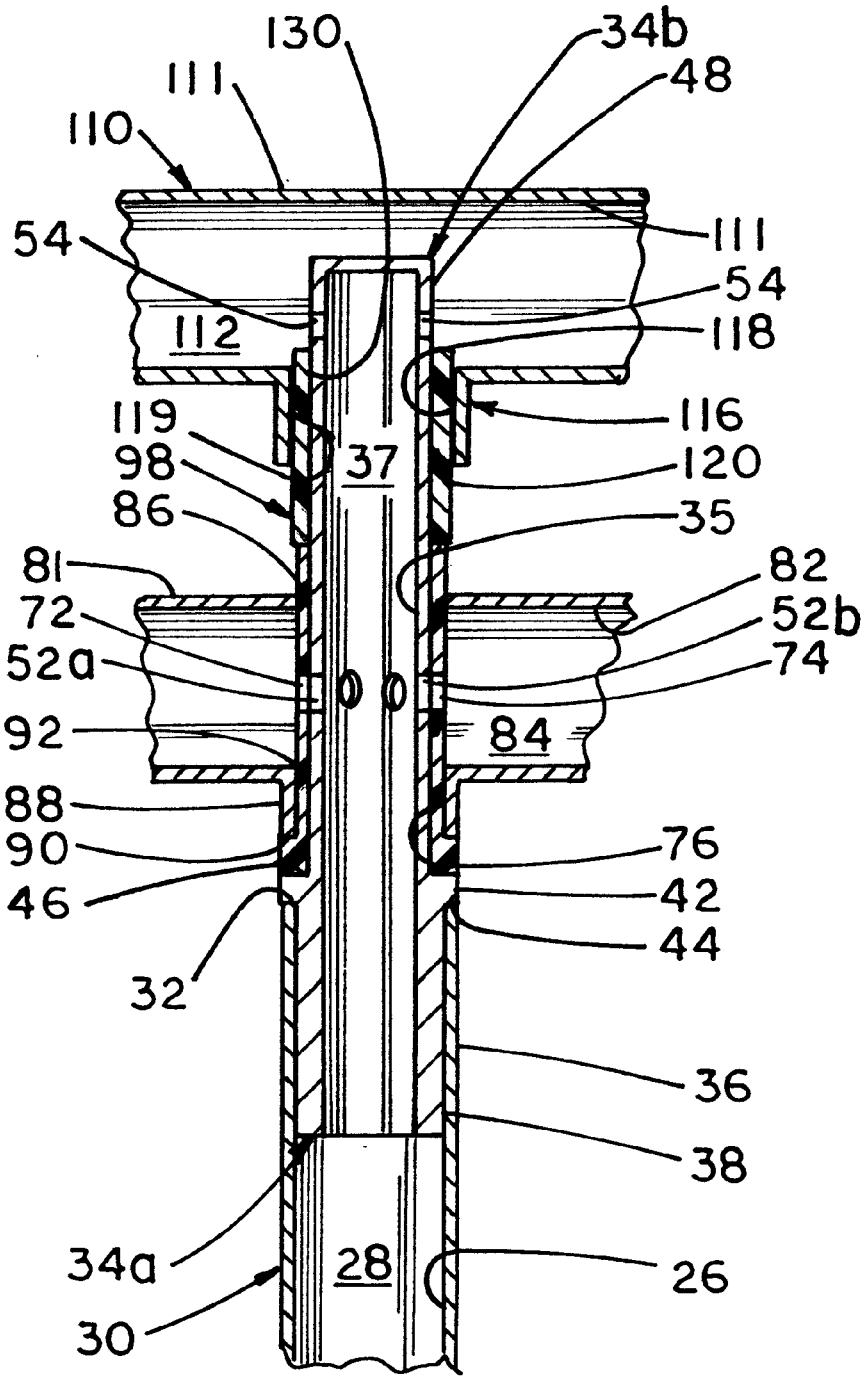
FIG. 4 is a cross sectional view showing a portion of the lawn sprinkler of FIG. 1.

Elbow pipe 20 has a first end 22 having a fitting thereon adapted for receiving the terminal end of a conventional garden hose. A generally hollow support tube (shown in phantom) 30 extends along a longitudinal axis and is interconnected to second end 24 of elbow pipe 20 such that the interior 28, FIGS. 3–4, of support tube 30 communicates with the interior (not shown) of elbow pipe 20. As best seen in FIG. 4, interior 28 of support tube 30 is defined by generally cylindrical inner wall 26.

Support tube 30 includes an upper edge 32 which supports bushing 34. Bushing 34 of bearing 11 includes a base portion 36 which is received in the interior 28 of support tube 30 and base portion 36 of support bushing 34 includes an outer surface 38 which engages inner wall 26 of support tube 30. Bushing 34 has a first open end 34*a* and a second opposite closed end 34*b*. The inner surface 35 defines a flow cavity 37 within the interior of bushing 34. As best seen in FIG. 4, the interior 37 of bushing 34 communicates with the interior 28 of support tube 30.

Bushing 34 further includes a support shoulder 42 partially defined by a lower surface 44 which extends radially from the outer surface 38 of lower portion 36 of bushing 34 and which engages the upper edge 32 of support tube 30. Support shoulder 42 further includes an upper surface 46 extending radially between outer surface 48 of the upper portion 50 of bushing 34.

Outer surface 48 of upper portion 50 of bushing 34 includes a lower plurality of apertures 52 extending therethrough which are circumferentially spaced about the periphery of outer surface 48 of upper portion 50 of bushing 34. Upper portion 50 of bushing 34 also includes an upper pair of apertures 54 on opposite sides thereof.

Bearing 11 includes a generally cylindrical, hollow sleeve 60 which is positioned about the upper portion 50 of bushing 34. Sleeve 60 includes an upper end 61 and a lower end 62 having a support shoulder 64 extending radially therefrom. Support shoulder 64 is partially defined by a lower surface 66 which slidably engages the upper surface 46 of support shoulder 42 of bushing 34. Support shoulder 64 of sleeve 60 is also defined by an upper surface 68 extending radially from the outer surface 70 of sleeve 60. Outer surface 70 of sleeve 60 includes first and second apertures 72 and 74 on opposite sides thereof. Sleeve 60 further includes an inner surface 76 which forms a slidable interface with the outer surface 48 of the upper portion 50 of bushing 34. As best seen in FIG. 3, apertures 72 and 74 in sleeve 60 lie in a common plane with first set of apertures 52 in upper portion 50 of bushing 34.

A first ring shaped distribution member is generally designated by the reference numeral 80. First distribution member includes a generally tubular wall 81 having an inner surface 82 which defines a fluid passageway 84 therein. An opening 86 is provided in tubular wall 81. Tubular neck 88 is axially aligned with opening 86 and depends from the radially outer portion of first distribution member 80. Neck 88 terminates at a circular lower edge 90 which slidably engages the upper surface 68 of support shoulder 64 of sleeve 60. Sleeve 60 extends through first distribution member 80 through neck 88 and opening 86 such that inner surface 92 of neck 88 engages outer surface 70 of sleeve 60 in a fixed relationship.

It is contemplated that first distribution member 80 include a first set of fluid dispensing openings 96 on a first side 97 thereof which allows for fluid in the interior of first fluid distribution member 80 to be dispersed therefrom. Similarly, first distribution member 80 includes a second set of fluid dispensing openings 99 on a second side 101 thereof, FIG. 2, which allows for fluid interior first distribution member 80 to be dispersed therefrom.

Bearing 11 further includes an elongated, tubular spacer sleeve 98 positioned about the upper portion 50 of bushing 34. Spacer sleeve 98 includes first and second open ends 100 and 102, respectively. Open end 100 of spacer sleeve 98 terminates at a lower edge 104 which slidably engages the upper end 61 of sleeve 60.

A second, ring-shaped fluid distribution member is generally designated by the reference numeral 110. Second fluid distribution member includes a generally tubular wall 111 having inner surface 114 which defines a fluid passageway 112 therein. A tubular neck 116 depends from the radially outer portion of second fluid distribution member 110. Neck 116 includes a generally cylindrical inner surface 118 which defines a spacer sleeve receiving cavity 119 which communicates the fluid passageway 112 in fluid distribution member 110.

Support sleeve 98 extends into support sleeve receiving cavity 119 in neck 116 such that the inner surface 118 of neck 116 engages the outer surface 120 of spacer sleeve 98 in a fixed relationship. In its assembled condition, a closed end 34*b* of bushing 34 is received within fluid passageway 112 in second fluid distribution ring 110. Openings 54 in the upper portion 50 of bushing 34 are aligned with and received within fluid passageway 112 defined by the inner surface 114 of second fluid distribution member 110.

Figure 2:
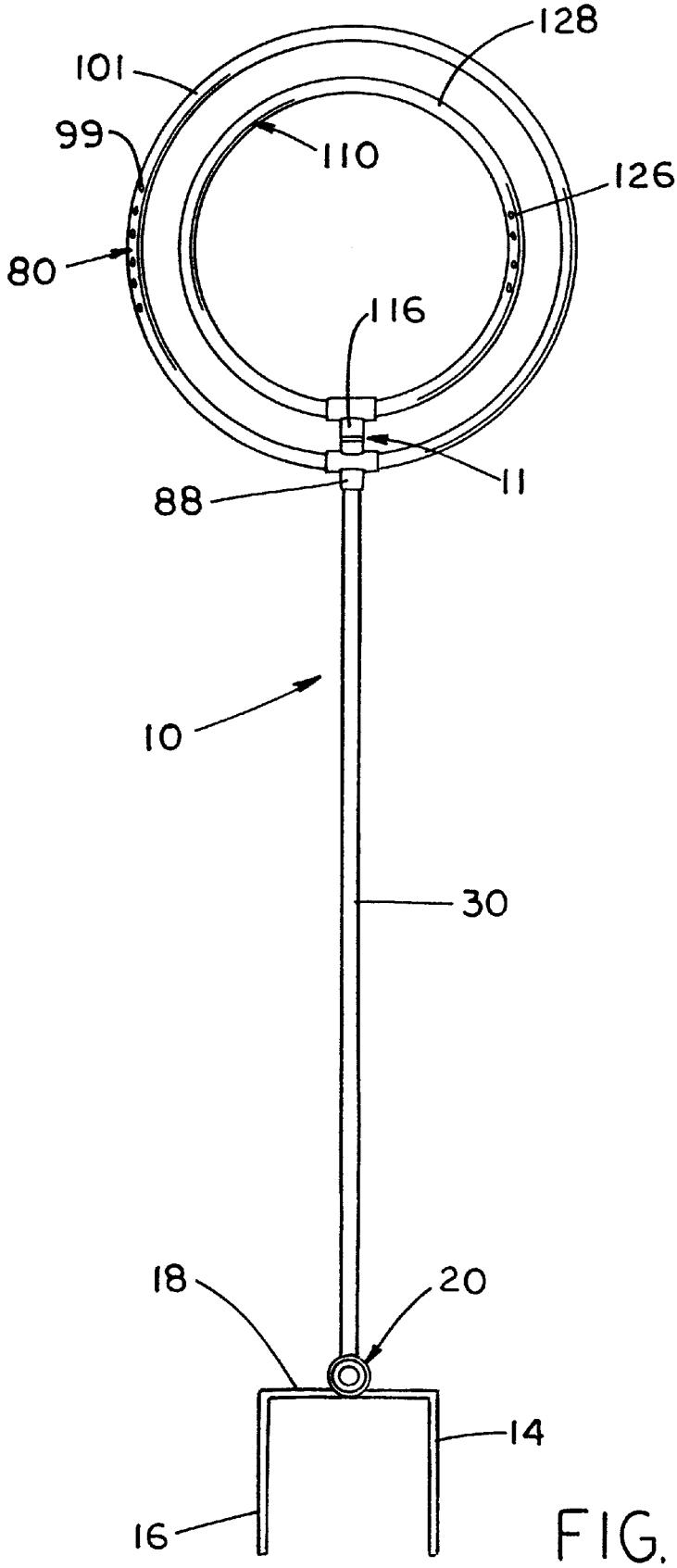
FIG. 2 is a rear elevational view of the lawn sprinkler of FIG. 1.

As best seen in FIG. 1, second fluid distribution member 110 includes a first set of fluid dispersing apertures 122 along a first, front side portion 124 thereof. Similarly, as best seen in FIG. 2, second fluid distribution member 110 includes a second set of dispersing apertures 126 extend through a second rear side 128 thereof.

In operation, lawn sprinkler 10 is assembled as heretofore described, and spikes 14 and 15 are inserted into the ground in a desired location such that support tube 30 extends vertically therefrom. First end 22 of elbow pipe 20 is connected to a conventional garden hose which, in turn, is connected to a fluid source (not shown). Fluid flows through the garden hose and the elbow pipe 20 into the interior 28 of support tube 30. Therefore, the fluid flows upwardly in support tube 30 into flow cavity 37 within the interior of bushing 34.

As is known, fluid takes the path of least resistance, and as such will attempt to exit bushing 34 through first and second sets of apertures 52 and 54, respectively, therein. Consequently, the fluid flowing through flow cavity 37 of bushing 34 will exit bushing 34 through apertures 52*a* and 52*b* which are axially aligned with corresponding openings 72 and 74, respectively, in sleeve 60 and into fluid passageway 84 in first fluid distribution member 80. The fluid fills fluid passageway 84 of first fluid distribution member 80 and exits the fluid passageway 84 of first fluid distribution member 80 through first and second sets of fluid dispensing openings 96 and 99.

Due to the fluid pressure associated with the exiting of the fluid from the first fluid distribution member 80, the fluid urges first fluid distribution member 80 clockwise. As the fluid exiting the first fluid distribution 80 urges first fluid distribution member 80 clockwise, the inner surface 76 of sleeve 60 forms a rotatable interface with the outer surface 48 of upper portion 50 of bushing 34 thereby allowing first fluid distribution member 80 to rotate about longitudinal axis of support tube 30. As sleeve 60 rotates in unison with first fluid distribution member 80, openings 72 and 74 in sleeve 60 are no longer aligned with corresponding apertures 52*a* and 52*b*, respectively, in bushing 34, but become aligned with the next successive apertures in the first set of apertures 52 in bushing 34. This process is repeated such that first fluid distribution member rotates about the longitudinal axis of support tube 30.

By blocking the flow of fluid into fluid passageway 84 when openings 72 and 74 in sleeve 60 are not aligned with any of the first set of apertures 52 in bushing 34, the fluid pressure within fluid passageway 84 varies. As a result, the fluid exiting the first fluid distribution member 80 through the first and second fluid dispensing openings 96 and 99 pulsates, thereby varying the distance traveled by the fluid exiting the first fluid distribution member 80.

In addition, a portion of the fluid in fluid cavity 37 of bushing 34 will exit bushing 34 through second set of apertures 54 and flow into fluid passageway 112 of second fluid distribution member 110. Due to the fluid pressure of the fluid in the fluid passageway 112 of second fluid distribution member 110, the fluid exits a second fluid distribution member through the first and second sets of fluid dispersing apertures 122 and 126, respectively. Due to the fluid pressure associated with the exiting of the fluid from the second fluid distribution member 110, the fluid urges the second fluid distribution member counterclockwise. As second fluid distribution member 110 is urged counterclockwise, the inner surface 130 of spacer sleeve 98 forms a rotational interface with the outer surface 48 of the upper portion 50 of bushing 34 so as to allow second fluid distribution member 110 to rotate counterclockwise about the longitudinal axis of support tube 30.

By allowing for the counter-rotation of first and second fluid distribution members 80 and 110, respectively, the lawn sprinkler 10 incorporating bushing 11 of the present invention provides for the even distribution of fluid over the entire area to be irrigated. In addition, the pulsating distribution of fluid from the first fluid distribution member 80 provides greater coverage of the area to be irrigated.

Various modes of carrying out the invention are contemplated as being within the scope of the following claims, particularly pointing out and distinctly claiming the subject matter regarded as the invention.

I claim:

1. A bearing for rotatably supporting first and second sprinkler elements on a supporting stand, each of the sprinkler elements having a corresponding neck, comprising:

a hollow, generally cylindrical bushing extending along a longitudinal axis and defining a fluid receiving chamber therein, the bushing including a first open end operatively connected to the supporting stand such that the fluid receiving chamber communicates with the interior thereof, and a second, opposite closed end, the bushing further including first and second sets of longitudinally spaced apertures therein, the first set of apertures received within the neck of the first sprinkler element and the second set of apertures received within the neck of the second sprinkler element;

a tubular bushing sleeve rotatably received within the neck of the first sprinkler element and on the bushing, the bushing sleeve having an aperture therethrough lying in a common plane with the first set of apertures in the bushing such that the interior of the first sprinkler element successively communicates with fluid receiving chamber in the bushing through the aperture in the bushing sleeve and through one of the first set of apertures in the bushing as the bushing sleeve rotates about the bushing in response to the flow of fluid from the fluid receiving chamber in the bushing to the interior of the first sprinkler element;

a generally tubular support sleeve rotatable supported on the bushing, the support sleeve extending along the longitudinal axis between the first and second sets of apertures in the bushing.

2. The bearing of claim 1 wherein the support sleeve is partially received in the second sprinkler element in a fixed relationship such that second sprinkler element and support sleeve rotate in unison about the bushing.

3. The bearing of claim 1 wherein the bushing sleeve extends through the first sprinkler element in a fixed relationship such that the aperture in the sleeve is aligned with the interior of the first sprinkler element and such that the bushing sleeve and the first sprinkler element rotate in unison about the bushing.

4. The bearing of claim 3 wherein the bushing sleeve includes a second aperture spaced from the aperture in the bushing sleeve and aligned with the interior of the first sprinkler element, the second aperture in the bushing sleeve lying in a common plane with the first set of apertures in the bushing.

5. The bearing of claim 1 further comprising a collar extending radially from the open end of the bushing, the collar engaging the supporting stand for preventing axial movement of the bushing on the supporting stand.

6. A bearing for a lawn sprinkler having first and second rotatable sprinkler elements supported on a support stand, each of the sprinkler elements having a corresponding neck, comprising:

a hollow, generally cylindrical bushing extending along a longitudinal axis and defining a fluid receiving chamber therein, the fluid receiving chamber communicating with the interior of support stand, the bushing including a first set of circumferentially spaced apertures therein which are received within the neck of the first sprinkler element; and a second set of circumferentially spaced apertures therein, the second set of apertures longitudinally spaced from the first set of apertures in the bushing and received within the interior of the second sprinkler element;

a bushing sleeve interconnected to and extending through the neck of the first sprinkler element, the bushing sleeve rotatably received on the bushing and having an aperture extending therethrough, the aperture lying in a common plane with the first set of apertures in the bushing such that the interior of the first sprinkler element successively communicates with fluid receiving chamber in the bushing through the aperture in the bushing sleeve and through one of the first set of apertures in the bushing in response to rotation of the bushing sleeve about the bushing;

a generally tubular support sleeve rotatably supported on the bushing, the support sleeve extending along the longitudinal axis between the first and second sets of apertures in the bushing.

7. The bearing of claim 6 wherein the support sleeve is partially received in the neck of the second sprinkler element in a fixed relationship such that second sprinkler element and support sleeve rotate in unison about the bushing.

8. The bearing of claim 6 wherein the bushing sleeve includes a second aperture circumferentially spaced from the first aperture in the bushing sleeve and aligned with the interior of the first sprinkler element, the second aperture in the bushing sleeve lying in a common plane with the first set of apertures in the bushing.

9. The bearing of claim 8 wherein the interior of the first sprinkler element successively communicates with fluid receiving chamber in the bushing through the second aperture in the first tubular sleeve and through one of the first set of apertures in the bushing in response to rotation of the first sprinkler element about the longitudinal axis.

10. A lawn sprinkler, comprising:

a hollow, support stand extending along a longitudinal axis, the support stand connectable to a fluid source for transmitting fluid therethrough;

a generally cylindrical bushing extending along a longitudinal axis and defining a fluid receiving chamber therein, the fluid receiving chamber communicating with the interior of the support stand, the bushing including a first set of circumferentially spaced apertures therein;

a fluid distributing member having a neck and a fluid dispersing opening therein to accommodate the flow of fluid therethrough;

a bushing sleeve extending through and interconnected to the neck of the fluid distributing member, the bushing sleeve rotatably received on the bushing and having an aperture therethrough, the aperture lying in a common plane with the first set of apertures in the bushing such that the interior of the fluid distributing member successively communicates with fluid receiving chamber in the bushing through the aperture in the bushing sleeve and through one of the first set of apertures in the bushing in response to rotation of the bushing sleeve about the bushing; and a second fluid distributing member having a plurality of fluid dispersing opening therein; and a generally tubular support sleeve interconnected to and partially received in the second fluid distributing member, the support sleeve rotatably supported on the bushing.

11. The lawn sprinkler of claim 10 wherein the fluid distributing member rotates in response to the flow of fluid through the fluid dispersing opening therein.

12. The lawn sprinkler of claim 10 wherein the bushing further includes a second set of circumferentially spaced apertures therein, the second set of apertures longitudinally spaced from the first set of apertures in the bushing and received within the interior of the second fluid distributing member.

13. The lawn sprinkler of claim 10 wherein the bushing sleeve includes a second aperture circumferentially spaced from the first aperture in the bushing sleeve and aligned with the interior of the first fluid distributing member, the second aperture in the bushing sleeve lying in a common plane with the first set of apertures in the bushing.

14. The lawn sprinkler of claim 13 wherein the interior of the first fluid distributing member successively communicates with fluid receiving chamber in the bushing through the second aperture in the bushing sleeve and through one of the first set of apertures in the bushing in response to rotation of the bushing sleeve about the bushing.

* * * * *

UNITED STATES PATENT AND TRADEMARK OFFICE

CERTIFICATE OF CORRECTION

PATENT NO. : 6,109,546

DATED : 08/29/00

INVENTOR(S) : Timothy G. Ormiston

It is certified that error appears in the above-identified patent and that said Letters Patent is hereby corrected as shown below:

Column 6, line 63, Claim 1; after "element" insert —and—.
Column 7, line 46, Claim 6; after "element" insert —and—.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*